US005174081A

United States Patent [19]

Reichartz

[11] Patent Number: 5,174,081

[45] Date of Patent: Dec. 29, 1992

[54] BUILDING ELEMENT FOR ERECTING BUILDINGS, PARTS OF BUILDINGS OR THE LIKE

[75] Inventor: Paul Reichartz, Korschenbroich, Fed. Rep. of Germany

[73] Assignee: Inter-Power of New York, Inc., Latham, N.Y.

[21] Appl. No.: 730,775

[22] PCT Filed: Jan. 29, 1990

[86] PCT No.: PCT/DE90/00051

§ 371 Date: Jul. 24, 1991

§ 102(e) Date: Jul. 24, 1991

[87] PCT Pub. No.: WO90/08866

PCT Pub. Date: Aug. 9, 1990

[30] Foreign Application Priority Data

Jan. 31, 1989 [DE] Fed. Rep. of Germany ..... 3902793
May 13, 1989 [DE] Fed. Rep. of Germany ..... 3915711

[51] Int. Cl.[5] ..... E04B 5/48

[52] U.S. Cl. ..... 52/263; 52/126.6; 52/79.9

[58] Field of Search ..... 52/79.7, 79.9, 79.14, 52/263, 221, 126.6

[56] References Cited

U.S. PATENT DOCUMENTS

| | | | |
|---|---|---|---|
| 3,780,480 | 12/1973 | Cvijanovic et al. | 52/227 |
| 3,861,093 | 1/1975 | Robinson | 52/79 |
| 4,330,970 | 5/1982 | Bonink | 52/125 |
| 4,343,125 | 8/1982 | Shubow | 52/236.8 |

*Primary Examiner*—Richard E. Chilcot, Jr.
*Assistant Examiner*—Matthew E. Leno
*Attorney, Agent, or Firm*—Mason, Kolehmainen, Rathburn & Wyss

[57] ABSTRACT

A building element for erecting buildings, parts of buildings or the like has at least one panel (3) which is horizontal in the position of use and which is provided with a reinforcement. Support elements (4) are mounted in the corner regions of the panel perpendicular to the plane of the panel. The reinforcement is a volume-supporting framework and the interior of the panel is a completely hollow cavity interrupted only by the reinforcement. At least the partial region of the reinforcement facing the top of the panel in the position of use is embedded in an upper embedding region, preferably of concrete. The reinforcement has edge ribs along the edges of the panel and intersecting diagonal ribs. Lattice girders are embedded in the ribs and are suspended at their ends in stiffening shoes. The suspension regions are embedded in concrete or the like.

12 Claims, 11 Drawing Sheets

Fig. 4
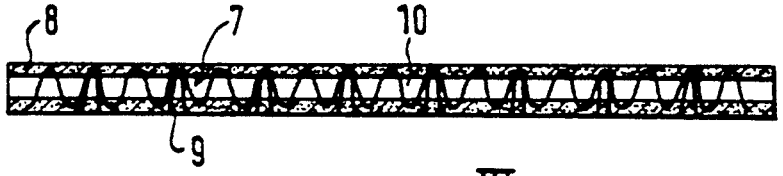
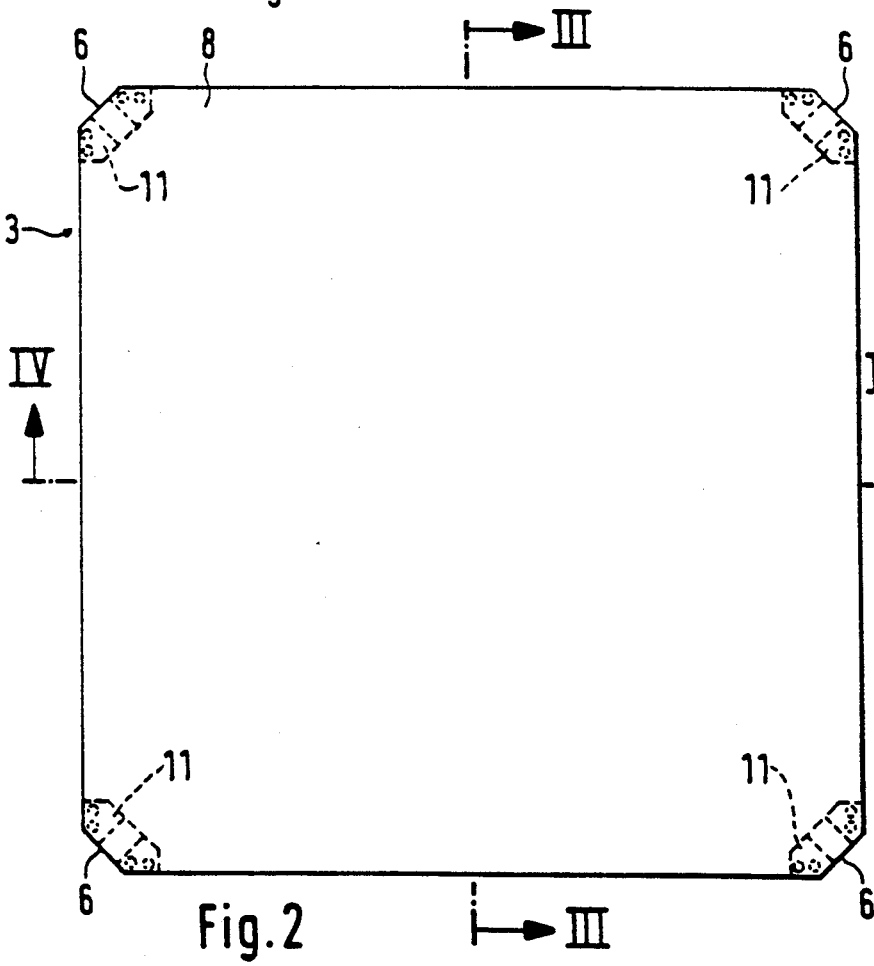
Fig. 2
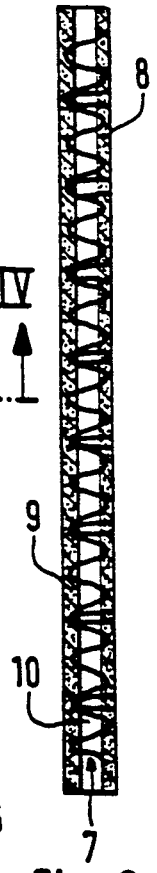
Fig. 3

BUILDING ELEMENT FOR ERECTING BUILDINGS, PARTS OF BUILDINGS OR THE LIKE

BACKGROUND OF THE INVENTION

1. Field of the Invention

The invention relates to a building element for erecting buildings, parts of buildings or the like.

2. Background of the Prior Art

German laid-open application (DE-OS) No. 24 27 568 discloses a building element for erecting buildings, which comprises a concrete-filled sheet metal profile structure and which is in the form of a table and which has a panel, two longitudinal side portions and four or more upright columns. Building elements of that kind may be used to erect individual storeys of a building by the building elements being fitted on to a row of finished cells which form the ground floor. As the panel of the table-like building elements simultaneously forms on the underside the ceiling and on the top side the floor for the storey thereabove, those building elements are substantially lighter than known finished cells and also require less material.

OBJECTS OF THE INVENTION

With building elements of that kind, there is the problem that, for static reasons, to prevent the panels from sagging, beam members or similar support elements must be provided. In the known building element the beam members are formed by longitudinal side portions. Furthermore it is difficult in relation to a building which is erected from building elements of that kind to arrange the required supply conduits for example for water, waste water, electricity, heating or the like, in such a way that on the one hand the construction is not weakened and on the other hand expensive and cost-intensive labour operations are avoided. In the known building element, it is not possible to dispose supply conduits within the building element.

SUMMARY OF THE INVENTION

German laid-open application (DE-OS) No. 24 38 376 discloses a latticework panel with upper and lower flange plates and struts connecting same. For the purposes of supporting a ceiling which is formed from a plurality of such latticework panels which are laterally connected together, on supports, the edge latticework panels each include a solid block at their outer ends. It is not possible for supply conduits or the like to be passed through the supports into the space between the upper and lower flange plates.

The invention is essentially based on the object of so designing a building element of the kind set forth in the opening part of this specification that no sagging effects which are relevant in practice occur even when the panel is of relatively large dimensions so that there is therefore no need for any beam members or the like. Another object is that of so designing the building element that conduits of any kind can be incorporated or arranged in an inexpensive fashion and without difficulties.

The building element according to the invention for the production of buildings, parts of building or the like as at least one panel which is horizontal in the position of use and which has a reinforcement. The reinforcement is in the form of a space frame structure. A portion of the reinforcement is embedded into an upper embedding region. Provided in the corner regions of the panel are support elements which extend transversely to the plane of the panel. For the purposes of connecting the panel to the support elements, arranged in the corner regions of the panel are stiffening shoes which are connected to the reinforcement. The stiffening shoes each have a top plate which is disposed parallel to the panel and a bottom plate which is disposed parallel to the panel, as well as a plurality of web plates which space the top and bottom plates. Provided in the stiffening shoes is at least one respective passage which is open to the interior region of the reinforcement and to the corner.

The fact that the reinforcement is in the form of a space frame structure means that no sagging which is relevant in a practical context occurs, even when the panel is of relatively large dimensions, so that in a building structure which is erected using such building elements, no beam members or the like are required. That therefore affords a very high level of planning options in regard to completion of the interior of a building erected from building elements of that kind. By virtue of the embedding region which is preferably made of concrete, the panel has a surface which is closed throughout. The cavity in the panel which is only interrupted by the space frame structure, beneath the upper embedding region, may serve to accommodate horizontally extending conduits of any kind. After the supply conduits have been introduced, that space can be closed off downwardly by means of panel-like cladding elements which bear against the underside of the space frame structure.

The forces, for example the forces caused by the weight of a building erected from building elements according to the invention, are carried by the stiffening shoes and transmitted by way of the respective support elements therebeneath to the lowermost building element. The at least one passage provided in the stiffening shoes serves to provide a communication between the cavity in the plane of the panel or the interior of the panel and the corner region. In that way supply conduits or the like can be passed through the support elements into the region of the space frame structure.

In a further configuration according to the invention it may be provided that the portion of the reinforcement which is towards the underside of the panel in the position of use is also embedded in a lower embedding region which extends over the plane of the panel so that a substantially continuous cavity is formed in the panel between the upper and lower embedding regions. That cavity is available for carrying or receiving conduits, for example heating conduits.

By virtue of the fact that the reinforcement is only embedded in an upper and possibly a lower embedding region of concrete or the like, the building element is low in weight, which has a particularly advantageous effect in regard to transportation and assembly.

In an advantageous configuration according to the invention, it may be further provided that the reinforcement which is a space frame structure is designed in the form of a bearer grid comprising lattice bearers with intersection points which are force-lockingly connected together, preferably welded. In that arrangement it is advantageous that a space frame structure of that kind can be produced without involving a high level of expenditure from components which are available on the market as mass-producted items. That means that the space frame structure can be produced inexpensively.

In accordance with a further feature of the invention it is provided that the building element has recesses at the respective corners. The recesses are for example in the form of bevels in the corners of the panel. The support elements also have recesses which are continuous in the longitudinal direction, preferably in the form of bevels, at their outer regions which are towards the corners.

If for example four building elements are arranged in side-by-side relationship and therefore four support elements are facing towards each other, the recesses provide between the support elements and the panel corners a vertically extending passage which opens in the region of the respective panels into the cavities provided in the panels so that the assembly in that way has vertical passages and horizontal cavities communicated therewith. The vertical passages and horizontal cavities can serve to accommodate conduits which are not visible either from the outside or from the inside of the building. The term conduits is not only used to denote supply conduits, but the conduits may also be for example floor heating, parts of an air conditioning installation or the like.

It may further be provided that the reinforcement has edge ribs extending along the edges of the panel and mutually intersecting diagonal ribs. That cross-wise reinforcement with edge stiffening effect gives rise to a considerable reduction in regard to material expenditure, and a high level of stiffness in regard to sagging of the building element.

In accordance with a further feature of the invention it is provided that the edge ribs and the diagonal ribs have lattice bearers which are embedded in concrete or the like and the lattice bearers are fixedly connected to each other and to the stiffening shoes at the points of intersection of the diagonal ribs and at the points of connection with stiffening shoes which are provided in the corner regions of the panel, by embedding of the points of intersection and the points of connection in concrete or the like.

Desirably the stiffening shoes have hook-like suspension devices for suspending loop-like end portions of the lattice bearers. As a result there is no need to make a fixed connection in respect of the diagonal ribs at the points of intersection and the edge ribs and the diagonal ribs with the stiffening shoes provided in the corner regions of the panel, for example by welding, as the fixed connection is easily achieved by virtue of the fact that the reinforcement of the diagonal ribs, which initially lies loosely against each other at the points of intersection, and the ends of the reinforcement of the edge ribs and the diagonal ribs, which ends are initially loosely fitted into the suspension devices of the stiffening shoes, are firmly connected by being embedded in concrete or the like. That makes it possible easily to make the connections of the diagonal ribs with each other and the connections of the edge ribs and the diagonal ribs to the reinforcing shoes provided in the corner regions, so that the building element is inexpensive to produce.

BRIEF DESCRIPTION OF THE DRAWINGS

Embodiments of the invention are described hereinafter with reference to the drawings in which:

FIG. 2 is a plan view of an embodiment of a building element, FIG. 3 is a view in section taken along line III—III in FIG. 2, wherein the support elements are not shown for the sake of enhanced clarity of the drawing, FIG. 4 is a view in section taken along line IV—IV in FIG. 3, wherein the support elements are not shown for the sake of improved clarity of the drawing.

DESCRIPTION OF PREFERRED EMBODIMENTS OF THE INVENTION

Figure 1:
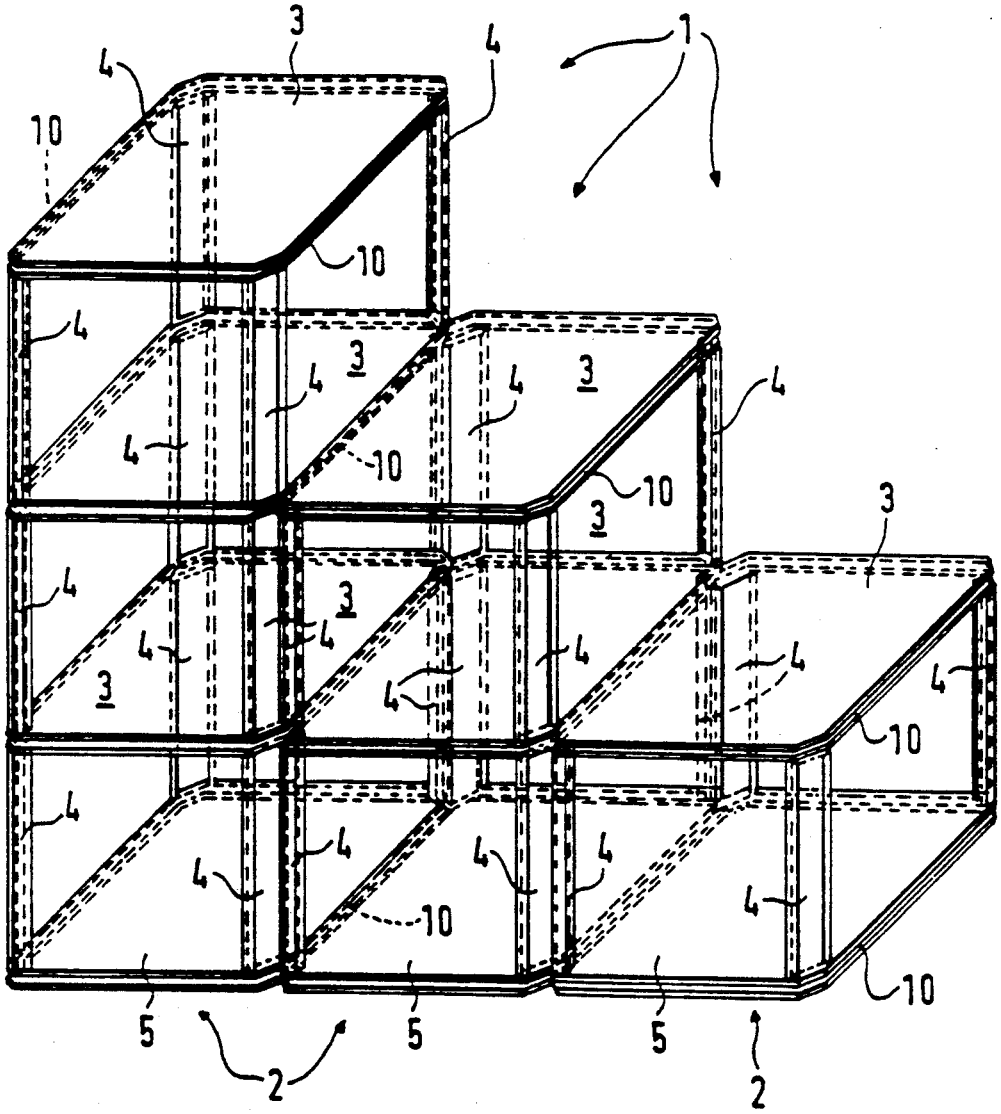
FIG. 1 is a diagrammatic view of a number of building elements which are arranged in side-by-side and superposed relationship.

In FIG. 1, a plurality of building elements 1 and 2 are arranged in side-by-side and superposed relationship. The building elements 1 each comprise an (upper) panel 3 and support elements 4 which extend transversely with respect to the plane of the panel. In addition to an upper panel 3 the building elements 2 also have a lower panel 5.

FIG. 2 shows a plan view of one of the panels 3. The corners of the panel are provided with bevels 6. The panel 3 has an interior reinforcement 7 which is constituted as a space frame structure in the form of a bearer grid consisting of lattice bearers with welded points of intersection. The reinforcement in the form of the space frame structure is embedded in its portion which faces towards the top side of the panel, in an upper embedding region 8 of concrete, which extends over the plane of the panel. The portion of the reinforcement 7 which faces towards the underside of the panel in the position of use is embedded in a lower embedding region 9 of concrete which extends over the plane of the panel. In that way, formed in the panel 3 is a cavity 10 which extends in the plane of the panel and which is continuous, apart from the reinforcement. The support elements 4 are not shown in FIGS. 3 and 4, for the sake of improved clarity of the drawing.

Figure 5:
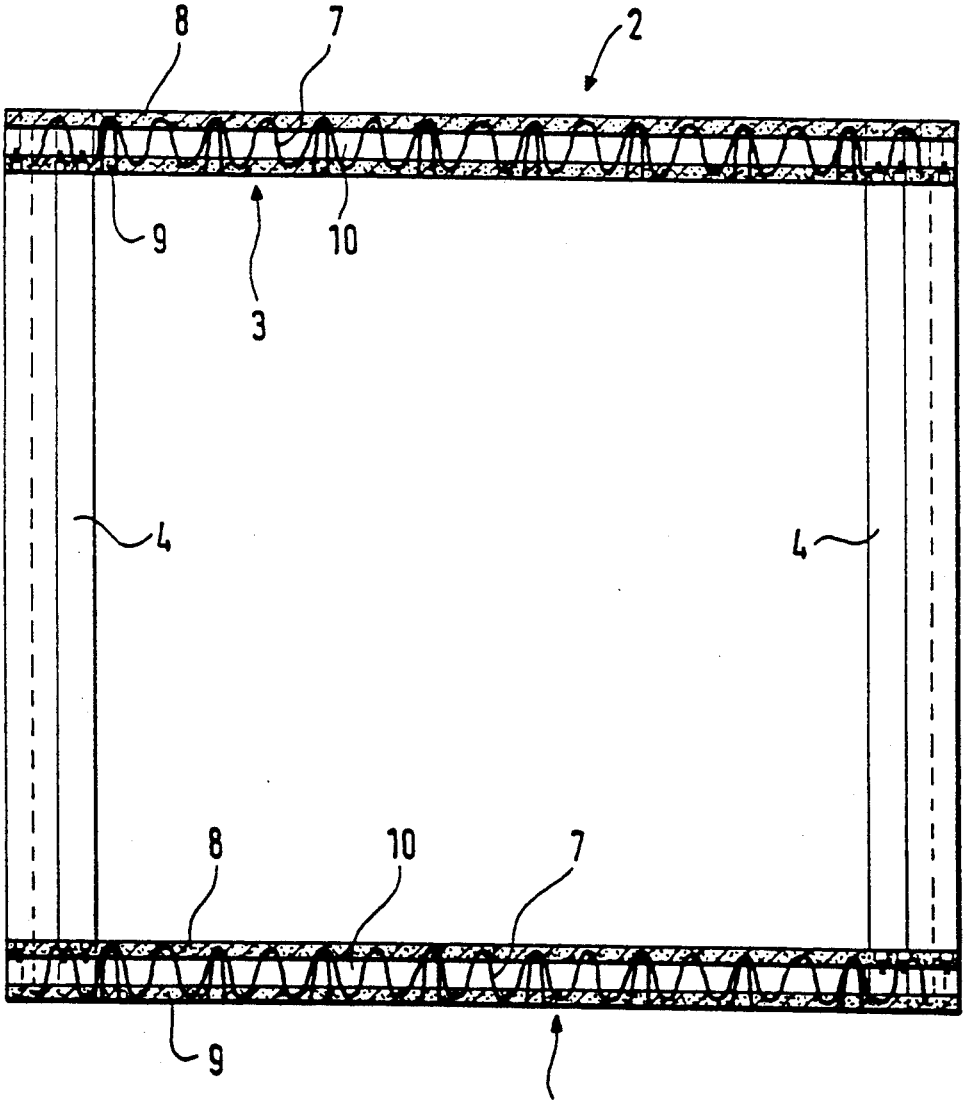
FIG. 5 is a sectional view taken along line IV—IV in FIG. 2 through a building element having an upper panel and a lower panel and support elements.

FIG. 5 is a view in cross-section through one of the building elements 2 illustrated in FIG. 1. The building elements 1 and 2 differ from each other in that the building elements 1 only have an (upper) panel 3 with support elements 4 extending downwardly thereon while in the case of the building elements 2, there is a further panel 5 disposed at the lower end of the supports 4, the structure of the panel 5 corresponding to that of the panel 3.

Figure 6:
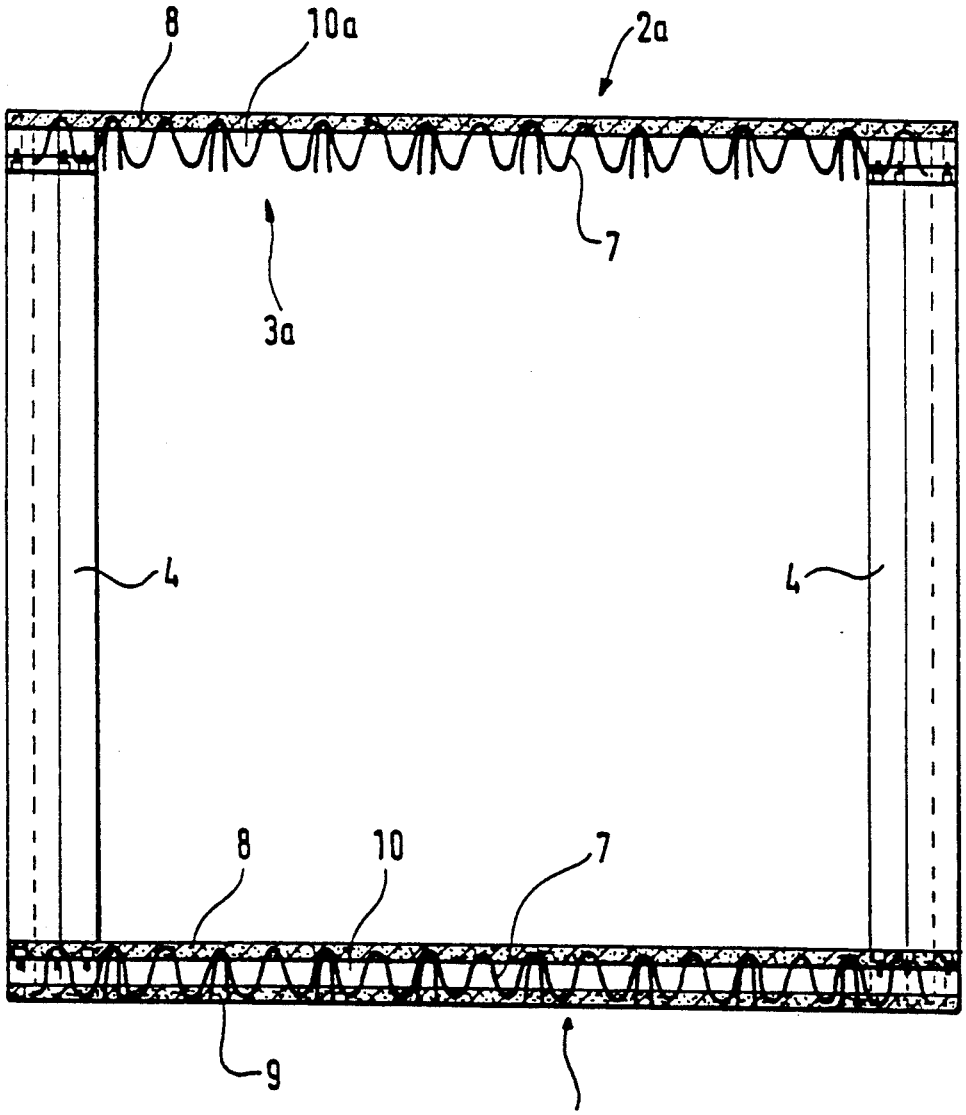
FIG. 6 is a view corresponding to that shown in FIG. 5 for a further embodiment in which the space frame structure forming the reinforcement is embedded only in an upper embedding region.

The building element shown in FIG. 6 and generally identified by reference numeral 2*a* differs from the building element 2 shown in FIG. 5 in that the upper panel which in this case is identified by reference numeral 3*a* has only an upper embedding region 8 but no lower embedding region 9. The downwardly open space 10*a* can serve, like the space 10, for accommodating horizontal conduits or the like. The absence of the lower embedding region 9 is found to be particularly advantageous in regard to fitting the conduits. The open underside of the space 10*a* can be readily closed by cover plates or the like after conduits have been fitted.

It can also be provided that the panels 3 of the building elements 1 only have an upper embedding region 8.

Figure 7:
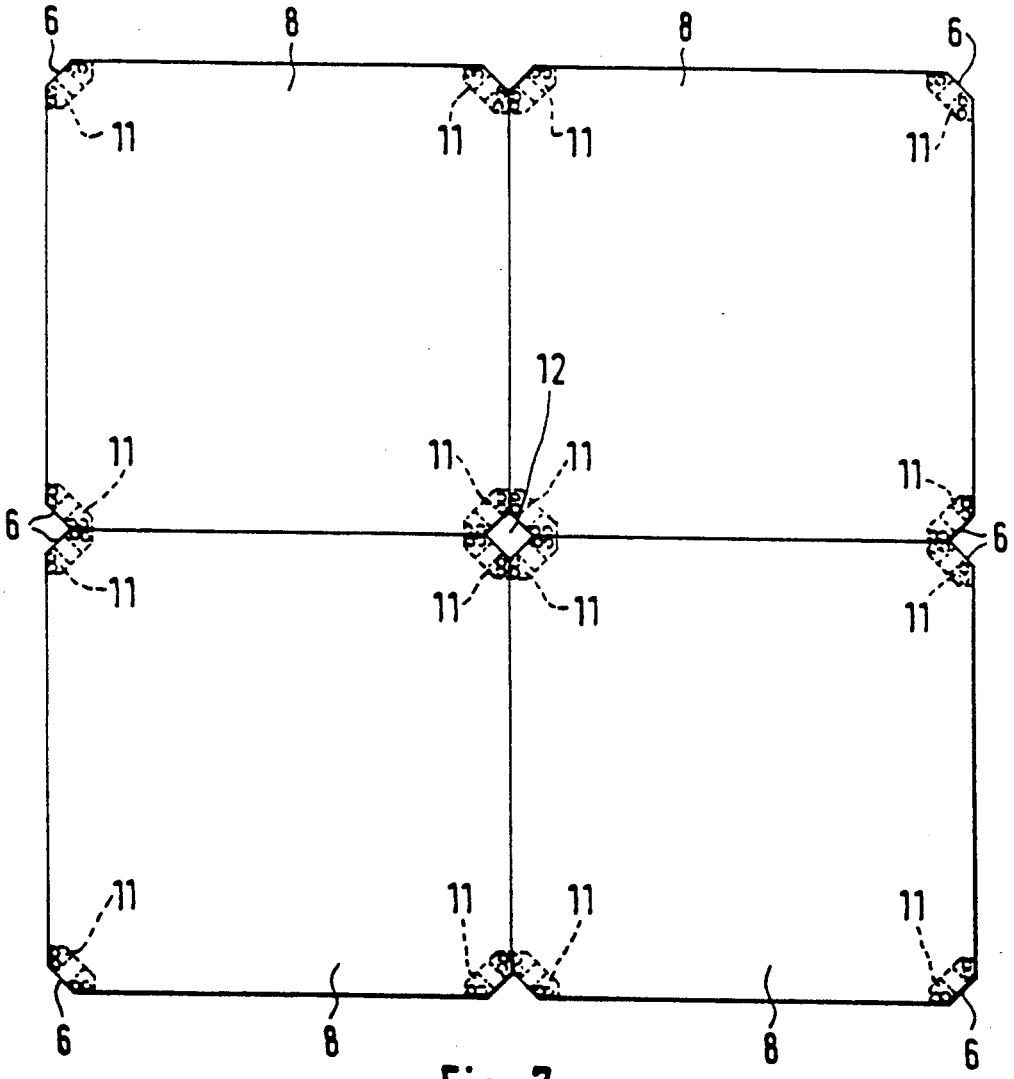
FIG. 7 is a diagrammatic plan view of four building elements which are arranged in side-by-side relationship.
Figure 8:
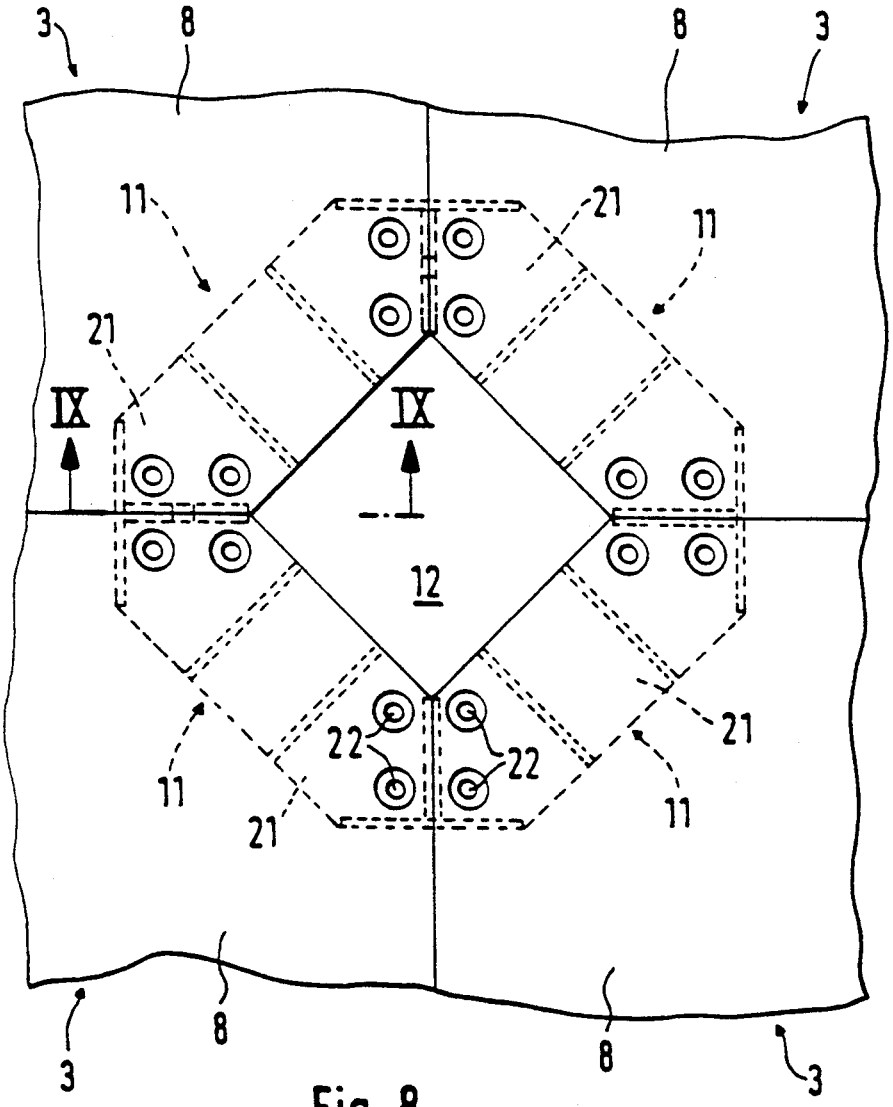
FIG. 8 is a view on an enlarged scale of the middle region of the view shown in FIG. 7.
Figure 10:
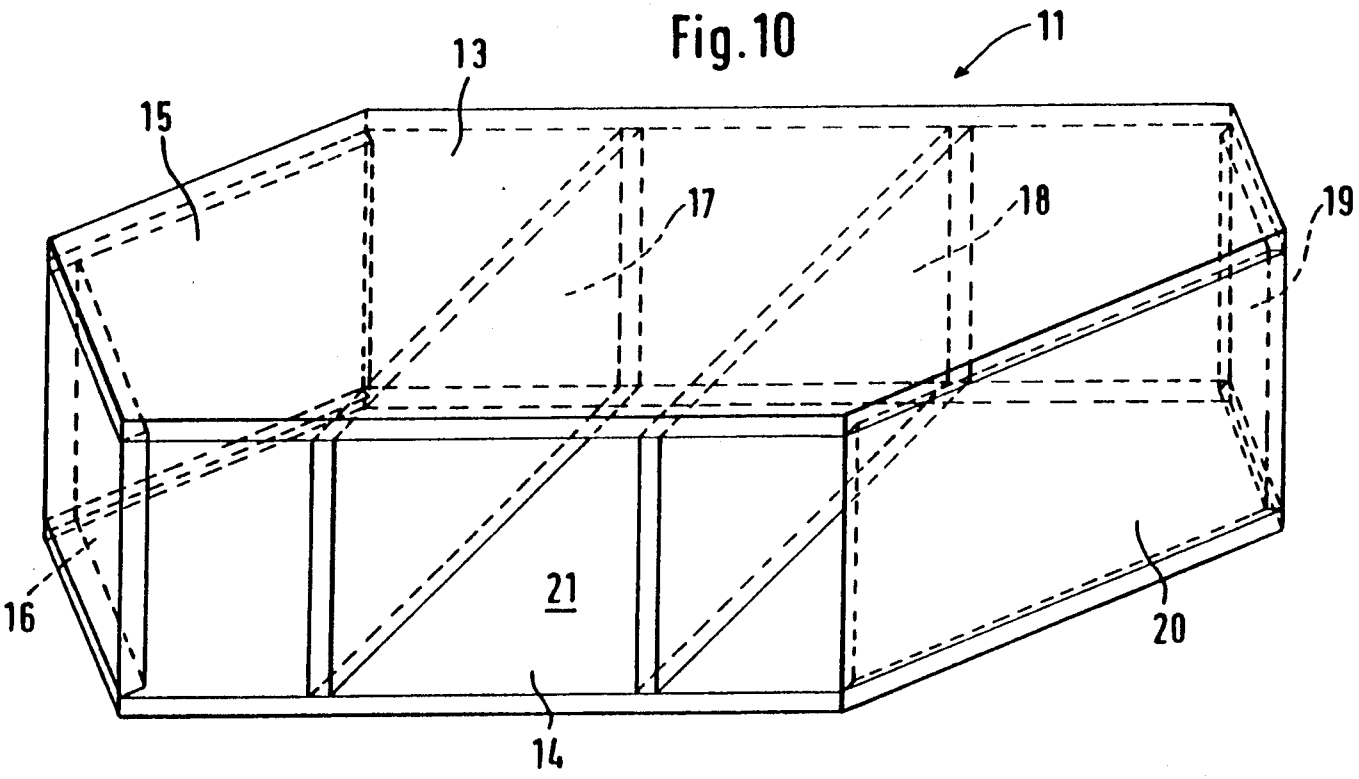
FIG. 10 is a diagrammatic perspective view of a stiffening shoe.

Embedded in the corner regions of the panels 3, 3*a* and 5 are stiffening shoes 11 which are shown on an enlarged scale in FIG. 10. In relation to building elements which adjoin each other, the bevels 6 which are provided in the corners of the panels form passages 12, as can be seen from FIGS. 7 and 8. It should also be mentioned that the support elements 4 also have bevels at their corners. In that way the passages 12 are of a continuous nature in a vertical direction and can accommodate vertically extending conduits or the like.

The stiffening shoes 11 each comprise a top plate 13 and a bottom plate 14 which are connected together by way of web plates 15, 16, 17, 18, 19 and 20. In that way a continuous passage 21 is formed between the web plates 17 and 18 and the top plate 13 and the bottom plate 14.

Figure 11:
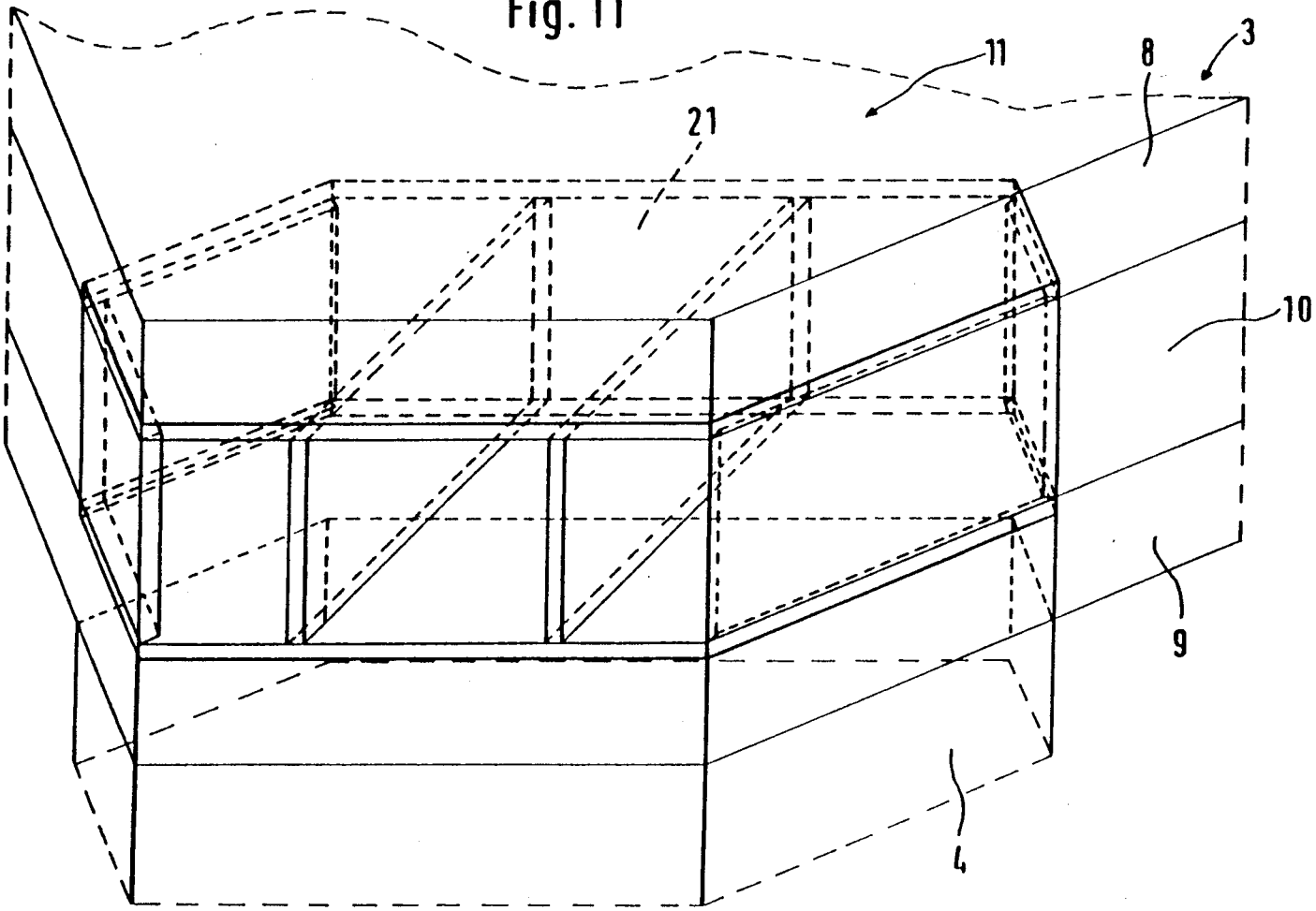
FIG. 11 is a diagrammatic perspective view of the stiffening shoe shown in FIG. 10, which is embedded in an upper and a lower embedding region of the panel.

By way of that passage 21, the cavity 10 which is horizontal in the position of use or the space 10*a* and the vertical passages 12 are connected together. For the sake of enhanced clarity of the drawing. FIG. 10 does not show any fixing means for the support elements 4, on the stiffening shoes 11. As can be seen from FIG. 11, the stiffening shoes 11 are each embedded in the upper embedding region 8 and the lower embedding region 9 of a panel 3. For the sake of enhanced clarity of the drawing FIG. 11 does not show the reinforcement in the form of the space frame structure, but the drawing diagrammatically indicates that a support element 4 is joined thereto in a downward direction. Fixing elements for the support element 4 are also not shown in FIG. 11.

Figure 9:
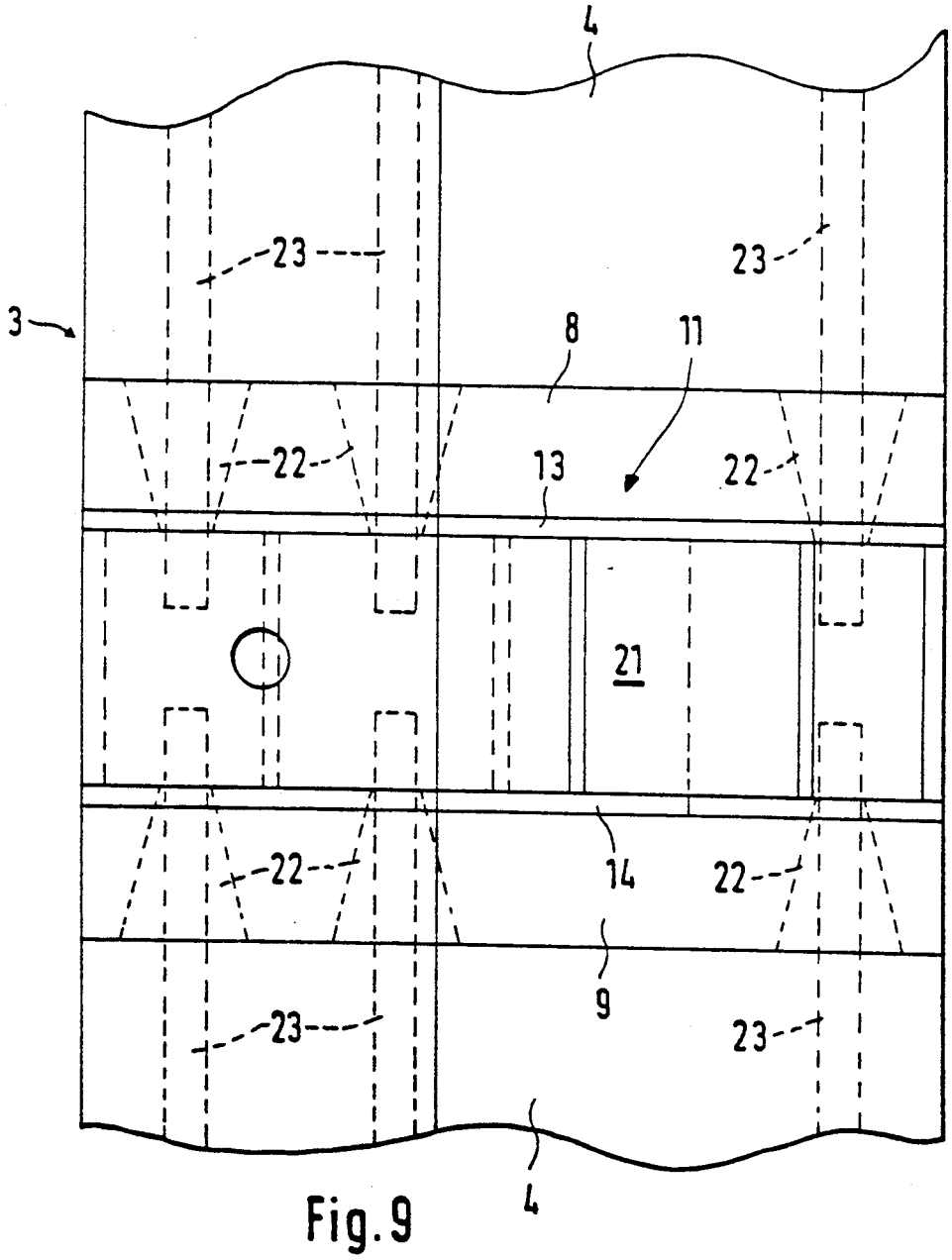
FIG. 9 is a partial view of FIG. 8 taken along line IX—IX on an enlarged scale.

FIG. 9 diagrammatically shows the connection of upwardly and downwardly facing support elements 4 to the corner regions of a panel 3. A stiffening shoe 11 is embedded in the corner region of the panel 3. The upper embedding region 8 and the lower embedding region 9 each have conical recesses 22 which open into openings in the top plate 13 and the bottom plate 14. Extending through the openings are screw bolts 23 which are fixedly let into the ends of the support elements 4. Nuts (not shown) are screwed for fixing purposes on to the ends of the screw bolts 23, which project into the interior of the stiffening shoes 11.

Figure 13:
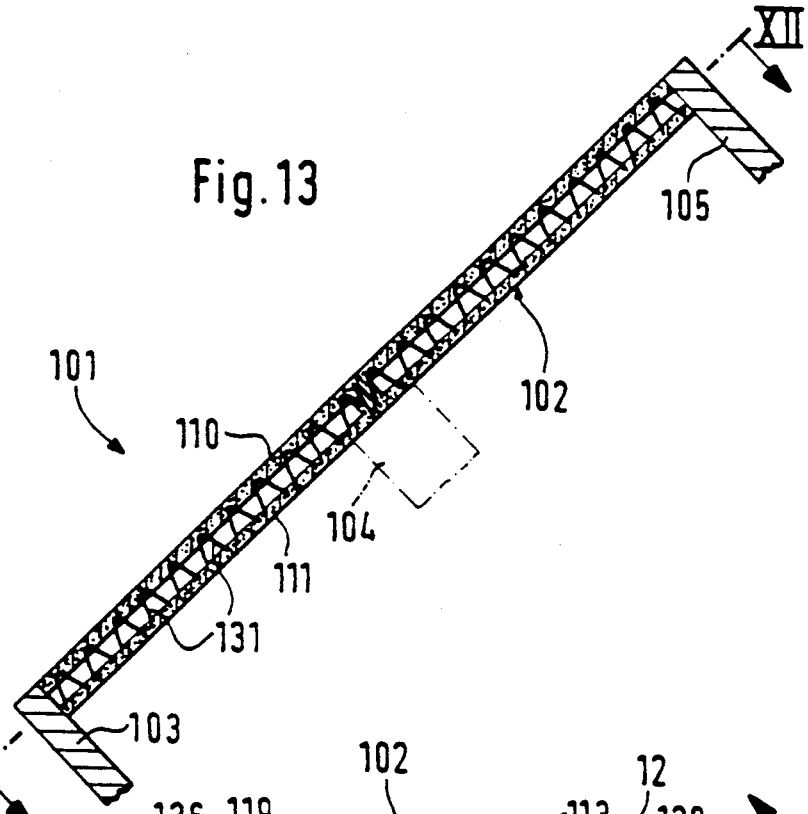
FIG. 13 is a diagrammatic view in section taken approximately on line XIII—XIII in FIG. 12, although the stiffening shoes in the corner regions are not shown.
Figure 12:
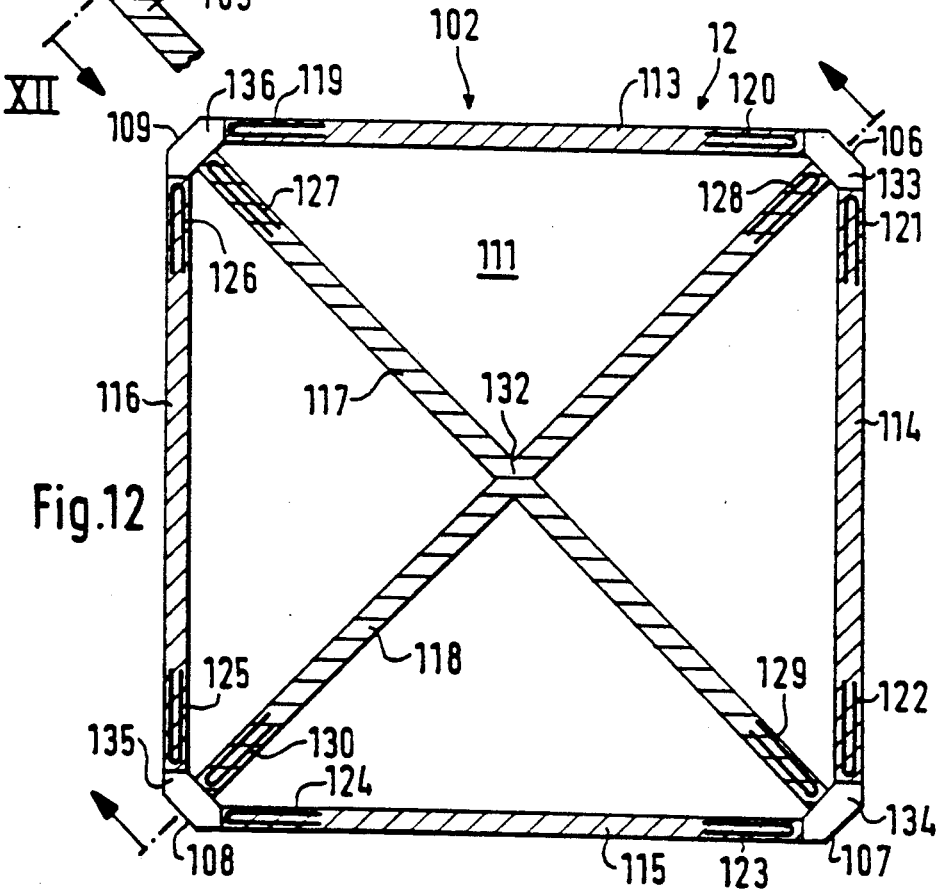
FIG. 12 is a diagrammatic plan view of the panel of a building element in section approximately taken along line XII—XII in FIG. 13.

A building element which is generally identified by reference numeral 101 in FIGS. 12 and 13 comprises a panel 102 which is arranged horizontally in the position of use. Provided in the corner regions of the panel are support elements which extend transversely with respect to the plane of the panel. The support elements are diagrammatically shown in FIG. 13 and are identified therein by references 103, 104 and 105. At the corners the building element has respective recesses in the form of bevels 106 and 109.

The panel 102 has an upper embedding region 110 and a lower embedding region 111. The embedding regions 110 and 111 comprise concrete or the like.

The panel is further provided with a reinforcement. The reinforcement comprises edge ribs 113, 114, 115 and 116 extending along the edges of the panel and mutually intersecting diagonal ribs 117 and 118. Embedded in the ribs 113 through 118 are lattice bearers which at least at the ends have loop-like end portions 119 through 130 which extend substantially horizontally in the position of use. Moreover the lattice bearers have per se known lattices 131 (see FIG. 13). The point of intersection of the lattice bearers of the diagonal ribs 117 and 118 is identified by 132. The lattice bearers are each embedded in concrete and in that way form the edge ribs 113, 114, 115 and 116, and the diagonal ribs 117 and 118. In addition the edge ribs and the diagonal ribs are connected to the upper embedding region 110 and the lower embedding region 111, more specifically by virtue of that connection being made during production by pouring and compacting the concrete.

Figure 14:
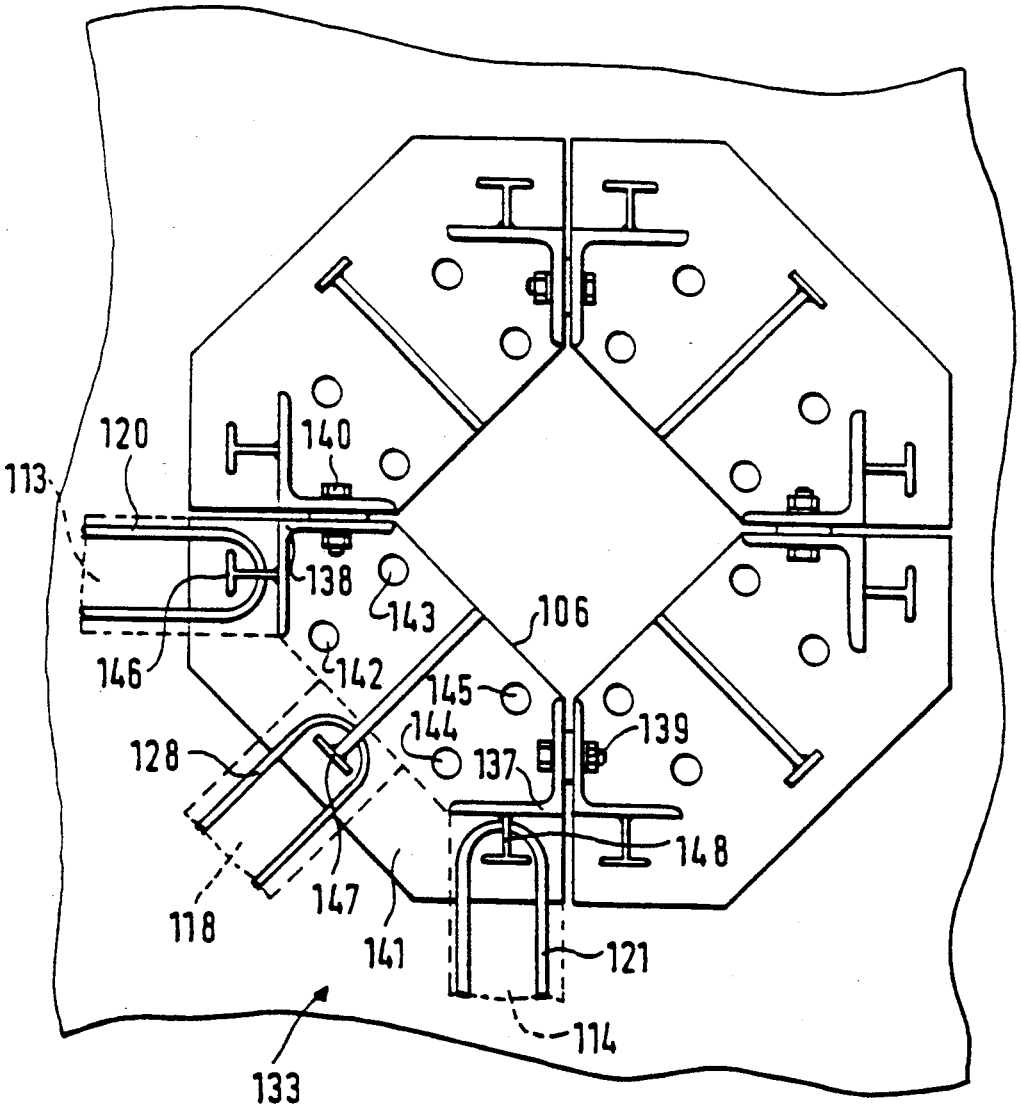
FIG. 14 is a diagrammatic plan view of the junction point formed by the connection of four building elements as shown in FIG. 12 at the middle, wherein the respective top plates of the stiffening shoes are not shown, and the connections of the edge ribs and the diagonal ribs are diagrammatically illustrated only for one stiffening shoe.

In the corner regions the building element has stiffening shoes 133, 134, 135 and 136. FIG. 14 shows the corner illustrated at top right in FIG. 12, with the stiffening shoe 133 which has the bevel 106. For connecting individual building elements 101 together with further building elements, the stiffening shoes provided at the respective corners are screwed at angle members 137 and 138 to corresponding angle members of adjoining stiffening shoes of adjoining building elements. The screws are diagrammatically indicated at 139 and 140 in FIG. 14. The stiffening shoes also each have a top plate (not shown in FIG. 14) which is substantially horizontal in the position of use and a bottom plate 141. The top plate and the bottom plate each have openings 142, 143, 144 and 145 for mounting one of the support elements 103, 104 and 105. The stiffening shoes also have suspension devices for suspension of the loop-like end portions of the edge ribs of the diagonal ribs. In FIG. 14 the loop-like end portions 120 and 121 of the edge ribs 113 and 114 and the loop-like end portion 128 of the diagonal rib 118 are shown in diagrammatic form. The loop-like end portions 120, 121 and 118 respectively are suspended in suspension devices 146, 147 and 148 on the stiffening shoe 133. Then, the suspension regions were embedded in concrete in production of the building element 101 so that a fixed connection was produced in that way.

I claim:

1. A building element for erecting buildings, parts of buildings or the like comprising a metal reinforced concrete panel which is horizontal in the position of use and which is provided with metal reinforcement, said reinforcement comprising a plurality of elongated steel reinforcing elements extending across said panel in traverse directions, each of said elements having upper portion embedded in said panel, said panel characterized in that at least some of said reinforcement elements (7), are connected in corner regions of said panel (3, 3*a*, 5) to metal stiffening shoes (11), said shoes adapted to be connected to vertical support elements (4), each of said stiffening shoes having a top plate (13) aligned parallel of a surface of said panel, a bottom plate (14) aligned in parallel with said top plate and a plurality of web portions (15, 16, 17, 18, 19, 20) extending between and interconnecting said top and bottom plates in spaced apart relation, said top and bottom plate and a pair of said web portions of at least one of said stiffening shoes defining a utility access passage (21) which is open at an outer end adjacent a corner of said panel and an open inner end in communication with a generally open space adjacent a lower surface of said panel wherein said reinforcement elements are extended whereby utility conduits running along said supports at one or more corners of said panel can be extended through said open ended passage of said stiffening shoes into said open space adjacent said lower surface of said panel.

2. The building element of claim 1 comprising a pair of said metal reinforced panels maintained in parallel spaced apart relation from each other by said metal reinforcement, said reinforcement elements including lower portions embedded in a lower one of said panels.

3. The building element as set forth in claim 1 characterized in that said reinforcement element (7) is in the form of a bearer bridge comprising lattice bearers with intersection points which are force-lockingly connected.

4. The building element as set forth in claim 3 characterized in that said intersection points are welded.

5. The building element as set forth in claim 1 characterized in that said building element has recesses at the respective corners.

6. The building element as set forth in claim 5 characterized in that said recesses are generally triangular in form (6) adjacent corners of said panel (3, 3*a*, 5).

7. The building element as set forth in claim 5 characterized in that said vertical support elements (4) have recesses which are continuous in the longitudinal direction at their outer regions which are open towards said corners of said panel.

8. A building element as set forth in claim 7 characterized in that said recesses of said vertical support elements are in the form of bevels.

9. The building element as set forth in claim 7 characterized in that said support elements in coaxial alignment (4) are arranged adjacent each other in a storeywise manner at their ends adjacent a level of said access passage.

10. The building element as set forth in claim 1 characterized in that said metal reinforcement includes at least one of said reinforcing elements (113, 114, 115, 116) extended along each edge of said panel and a pair of intersecting reinforcing elements (117, 118) extending between diagonally opposite corners of said panel.

11. The building element as set forth in claim 10 characterized in that said reinforcing elements extend along at least one pair of intersecting outer side edges of said panel (113, 114, 115, 116) and said reinforcing elements have lattice bearers which are embedded in concrete or the like and the lattice bearers are fixedly connected to each other and to an element extending diagonally of said corner (117, 118) and at the points of connection with said stiffening shoes (133, 134, 135, 136) provided in the corner regions of said panel (102), said connections including the embedding of the intersection points and the connecting points in concrete or the like.

12. The building element as set forth in claim 11 characterized in that said stiffening shoes have hook-like suspension devices (146, 147, 148) for the suspension of loop-like end portions (119 through 130) of said lattice bearers.

* * * * *